United States Patent [19]

Kunimoto et al.

[11] 4,372,457

[45] Feb. 8, 1983

[54] CLOSURE CAP HAVING PRIZE MARKINGS AND PEELABLE LINER

[75] Inventors: Go Kunimoto, Chigasaki; Isao Ichinose, Hiratsuka; Noboru Suzuki, Fujisawa; Fumio Mori, Yokohama, all of Japan

[73] Assignee: Toyo Seikan Kaisha, Ltd., Tokyo, Japan

[21] Appl. No.: 97,370

[22] Filed: Nov. 26, 1979

[30] Foreign Application Priority Data

Nov. 25, 1978 [JP] Japan ..... 53-144968
Jul. 18, 1979 [JP] Japan ..... 54-090334

[51] Int. Cl.[3] ..... B65D 53/04
[52] U.S. Cl. ..... 215/228; 215/254
[58] Field of Search ..... 215/228, 230, 341, 343, 215/347, 254

[56] References Cited

U.S. PATENT DOCUMENTS 4,157,143 6/1979 Doi ..... 215/228

*Primary Examiner*—Donald F. Norton
*Attorney, Agent, or Firm*—Pennie & Edmonds

[57] ABSTRACT

A closure cap having a liner adhered to a cap shell by a plurality of coating layers. Prize markings are printed on one of the coating layers and are positioned between the coating layers. The peel resistance in the interface between the coating layers is less than that between the topmost coating layer and the liner to assure that the prize markings will be transferred to the liner when the liner is peeled from the cap shell. The liner includes a starting portion which adheres to the topmost coating layer only slightly to facilitate easy removal of the liner from the cap shell.

14 Claims, 9 Drawing Figures

CLOSURE CAP HAVING PRIZE MARKINGS AND PEELABLE LINER

FIELD OF THE INVENTION

The present invention relates to a closure cap having a peelable liner and more specifically to a closure cap having a liner peelable from a cap shell together with a coating so that a printed ink layer indicating a prize mark is transferred to the liner.

BACKGROUND OF THE INVENTION

Closure caps in the form of crown caps and container caps having a liner and a cap shell peelably bonded together have been used in the sale of bottled products where a prize marking indicating a prize has been included with the closure cap.

Crown caps or other container caps commonly used to date have comprised a sheet of metal which has been coated with a protective paint. The sheet is then formed into the shape of a crown shell or cap shell and a liner adhered to the inside of the formed shell. Where the caps are used with bottled beverages with which a prize is offered, the common practice has been to award a prize in exchange for a predetermined number of liners or a winning liner which is brought to a store by a consumer or a buyer. It is necessary that the crown cap or container have a liner which is easily peelable from the cap shell. At the same time, it is necessary that the liner adhere to the cap shell to such a degree that it will not come off during the process of forming the cap, during shipment of the cap or during bottle capping procedures. Furthermore, the shell must have a sufficient corrosion resistance against any contents of a bottle which might cause corrosion and this corrosion resistance must withstand climbing, roll-on and other forming processes. Moreover, from the standpoint of hygienics, any ink layer comprising any printed prize mark on the liner surface must not directly contact the bottled beverage and, considering that the liner itself is applied to the cap shell in the form of fluid, it is desirable that any ink layer applied on the inside of the cap shell be transferred and adhered to the liner when the liner is peeled off its shell.

In order to achieve the requirements outlined above, it has been proposed to utilize a crown cap having the cap shell and the liner bonded together through a peelable coating to coating interface. In such a crown shell the liner is bonded to the shell with a sufficient adhesion to prevent it from coming off the shell by vibration during transportation and corking of the cap. To peel such a coating to coating interface, it is necessary to break one of the coatings with a considerably large force. As a result, it is often difficult to peel the liner from the shell in such a manner that one of the coatings adheres completely to the liner to assure that an ink layer indicating a prize mark is transferred to the side of the liner in unbroken form.

Accordingly, it is an object of our invention to provide a closure cap comprising a cap shell and a liner bonded together through a peelable coating to coating interface, and including a peelable starting portion of the liner at which one of the coatings is easily broken. This will then permit the ink layer of a prize mark to transfer to the liner side in unbroken form together with the coating covering the ink layer.

Another object of the invention is to provide a closure cap with a liner having a provision for preventing accidental peeling of the liner from the shell but facilitating such peeling, if necessary, with fingers without the need of any special tools.

GENERAL DESCRIPTION OF THE INVENTION

Broadly a closure cap instructed according to our invention has a metalic cap shell, a liner adhered to the inside surface of the shell through a plurality of coated layers and an ink layer printed on one of the coating layers so that it is between the coating layers. The liner has a peelable starting portion, preferably in the form of a tab, in order that peeling of the liner from the cap shell may be easily initiated. The peel resistance of the interface between adjacent coating layers is less than that between the topmost coating layer adjacent the liner and the liner in order that when the liner is initially peeled from the cap, there will be a break in the coating layers so that the printed layer will be transferred to this liner in unbroken form. In addition, the peel resistance between the coating layers in an area adjacent the starting portion is less than the peel resistance between the coating layers in an area further away from the starting portion. This assures that there will be an easy initiation of the peeling of the tab from the topmost coating layer.

Preferably the closure has two coating layers where one of the layers is made of a hydrocarbon resin and the other layer is made of an epoxy resin. The layer containing the hydrocarbon resin in the area adjacent the starting portion is made of an undenatured hydrocarbon resin in order to form an area having little adhesion.

The liner of the closure preferably has a relatively thin wall center section and a thick wall peripheral section. The starting portion may be located in the thick wall of the peripheral section in which the initial peel would be towards the center of the liner. Alternatively the initial starting portion may be located in the thin wall center sections of the liner and would include a tab by which the initial peel is made from the center towards the edge of the liner.

Preferably broken or score lines define the edges of the easily peeled portion to assure that this portion will break away from the remaining portion of the liner.

Further it is preferable that the peel resistance between the topmost coating layer adjacent the liner in the area adjacent the peel starting portions and the liner be less than the peel resistance between the remainder of the topmost coating layer and the liner. This further assures that the starting portion may be easily peeled from the topmost layer by finger pressure and without the need of any special tool.

BEST MODE FOR CARRYING OUT THE INVENTION

Figure 1:
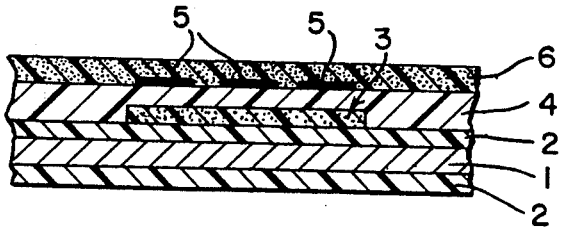
FIG. 1 is a sectional view of a coated sheet adapted to be formed into a cap shell according to the invention.

Referring to the drawings in which like elements have the same identifying numeral, there is illustrated in FIG. 1 a section of a coated metal sheet adaptable for forming into a cap shell. A known protective coating 2 is coated to both sides of the sheet 1 which is made of a tinned steel sheet or a tin-free steel sheet (a steel sheet electrolyzed with chromic acid). A first or bottommost coating 3 forming a peelable interface on the coated metal sheet is coated over coating 2, in such a manner that the shape and size of the coating 3 will be within the periphery of a liner which is subsequently applied after the sheet has been formed into a shell.

A second or intermediate coating 4 is coated over the entire surface of the first coating 3 to form a peelable interface with coating 3. A printed ink layer 5 is printed over the second coating 4 in a position corresponding to the coating 3 for indicating a prize mark. An adhesive or topmost coating 6 is provided over the printed ink layer.

Figure 2:
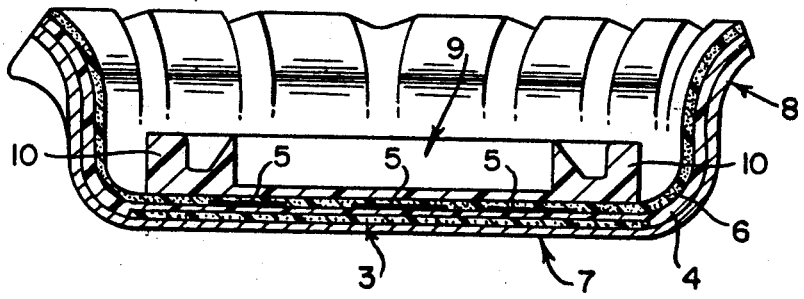
FIG. 2 is a sectional view of a crown cap according to the invention.
Figure 3:
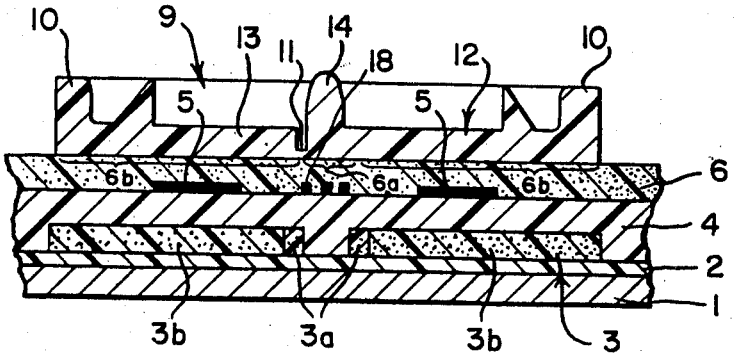
FIG. 3 is an enlarged sectional view of the crown cap of FIG. 2.
Figure 4:
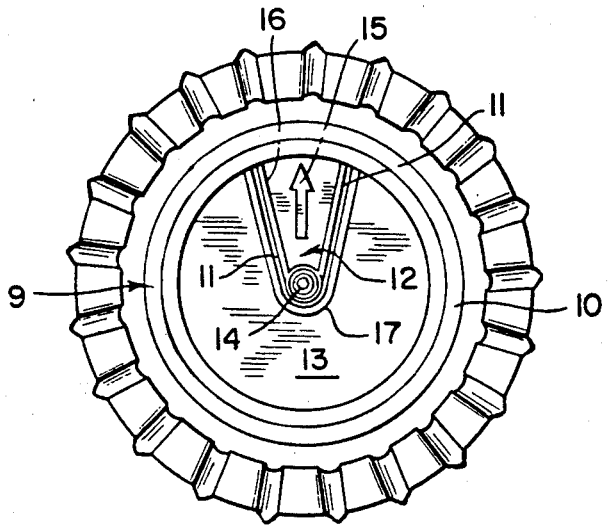
FIG. 4 is a plan view of the crown cap of FIG. 2.

The coated metal sheet 1 is punched into a shell shape having a circular top outer surface 7 and a corrugated skirt 8 to form a crown cap as shown in FIGS. 2–4. A liner 9 made of synthetic resin is bonded to the inside of the crown shell through the adhesive coating 6. The liner may have a thick portion or peripheral portion 10 to enhance sealing to the neck of a bottle (not shown).

A peel tab 12 is provided in a central section 13 of the liner and is defined by a completely cut or breakable weakened line or groove 11 which extends to the thick peripheral portion 10.

The term "completely cut" line means a line cut so deeply as to closely approach the adhesive coating 6 to substantially separate the tab 12 from the remaining central portion 13 of the liner. The terms "weakened line" means a line weakened with scores, perforations or their combination so that the tab 12 may break easily along the defining line 11.

The peel tab 12 is designed to make peeling possible along a width which is narrower than the central portion of the liner but which is sufficiently large to be picked up by the fingers when the entire liner is peeled off the cap. The line 11 defining the peeling tab 12 may take any shape such as V-shape, U-shape, S-shape and Z-shape in section.

To facilitate initial peeling of the tab 12, a knob 14 projecting in a direction normal to the top sheet is preferably positioned at the forward end of the tab 12. When the knob 14 is pressed with a fingertip or fingernail in the direction of peeling of the tab 12 (the direction of an arrow 15 in FIG. 4), the knob 14 serves as a lever, thus facilitating the process of peeling between the adhesive interface as described hereafter. The shape of the knob 14 may be cylindrical, semicylindrical or prismatic, but preferably of a truncated cone from the standpoint of moldability (separability from the mold).

In order that the tab 12 may be completely peeled without breaking, a relatively thick reinforcing rib 16 is provided inside the defining line 11 extending toward the thick peripheral portion 10. The knob 14 and the arrow 15 also acts as a reinforcing rib. When the defining line 11 is a weakened line, the relatively thick reinforcing rib 16 provided inside and along the weakened line helps to assure that the liner is broken only along the weakened line and that the tab is not broken apart from the weakened line. A thick reinforcing rib 17 may also be provided outside and along the weakened line to cooperate with the inside rib 15 to assure that breakage occurs along the weakened line when peeling is made.

Figure 5:
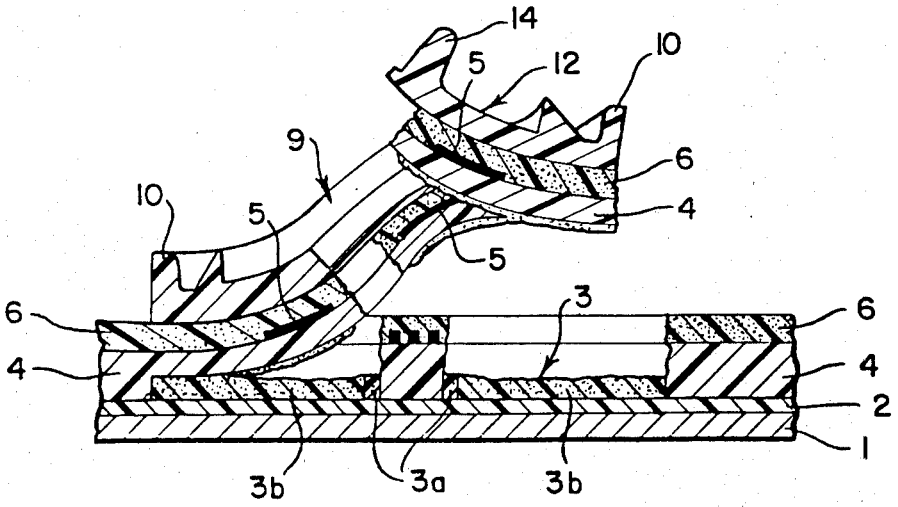
FIG. 5 illustrates peeling of the liner of the crown cap of FIG. 3.

According to the invention, a non-adhesive or weakly adhesive section 6*a* is formed where the initial peeling of the liner is to occur; i.e., the portion corresponding to the knob 14 in the interface between the liner 9 and the uppermost coating or adhesiving coating 6. A strongly adhesive section 6*b* is formed on the remaining interface portion between the liner and adhesiving coating 6. A non-adhesive or weakly adhesive section 3*a* is also formed along the direction of peel 15 the non-adhesive or weakly adhesive section 6*a* on the interface between the coatings 3 and 4. A peelable adhesive section 3*b* is formed on the remaining interface portion between coating 3 and 4. With such a composite adhesive structure, as shown in FIG. 5, when the liner 9 is to be peeled, the knob 14 is pulled up, the coatings 6 and 4 are readily broken above the radial outer edge of coating 3, and finally peeling is made between the coatings 4 and 3*b*. Thus, the peeling occurs in such a manner that the coatings 6 and 4 may adhere to the liner 9, thereby transferring the printed layer 5 situated between these coatings to the liner 9 in unbroken form.

If only a strongly adhesive section 3*b* is used between the first coating 3 and the second coating 4 to form a peelable interface, it is difficult to break the coatings 6 and 4 in the area where the initial peeling of the liner 9 is to occur. Breakage between these coatings occurs at random positions as the liner is peeled, making it difficult to transfer the printed layer 5 to the liner 9 in unbroken form.

If only a non-adhesive or weakly adhesive section 3*a* is formed between the coatings 3 and 4 to form a peelable interface, the liner 9 has a strong tendency of accidently detaching from the cap shell during pressing and bonding 7 the liner in the shell of during handling of the cap shell.

Figure 6:
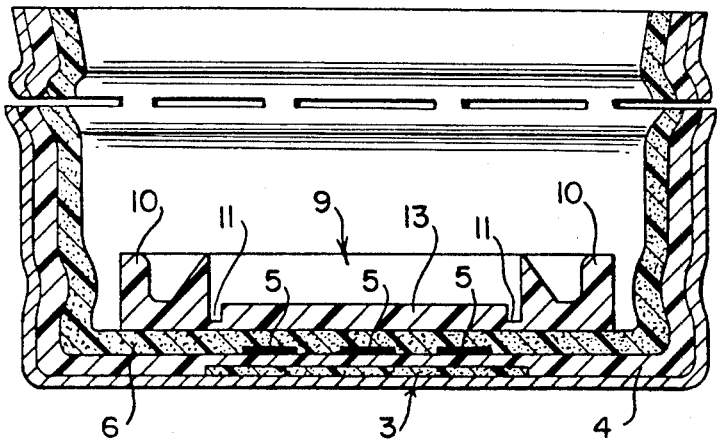
FIG. 6 is a sectional view of a container cap constructed according to the invention.

The closure cap of the invention may be formed as a reusable cap with a liner as shown in FIG. 6. The liner 9 has a seal portion 10, a thin central portion 13, and a completely cut or breakably weakened line 11 provided between the central portion and seal portions to permit the central portion 13 of the liner to be peeled. The cap may be used again with a container to reveal the same even after the liner has been peeled off to reveal the pointed layer.

Figure 7:
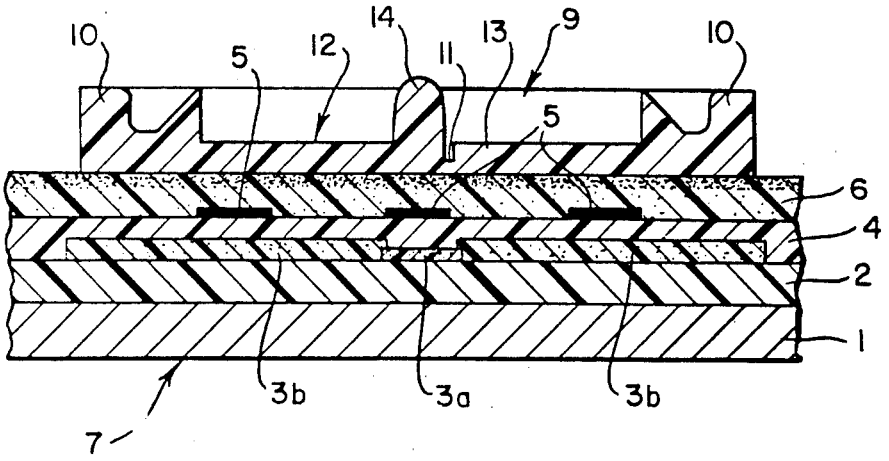
FIG. 7 is a sectional view of a further embodiment of a closing cap constructed according to the invention.

FIG. 7 illustrates an embodiment of a cap that is generally similar to that shown in FIG. 3 with the main difference being that the coating 6 is homogenous and does not include any section 6*b* nor weak adhesion.

Figure 9:
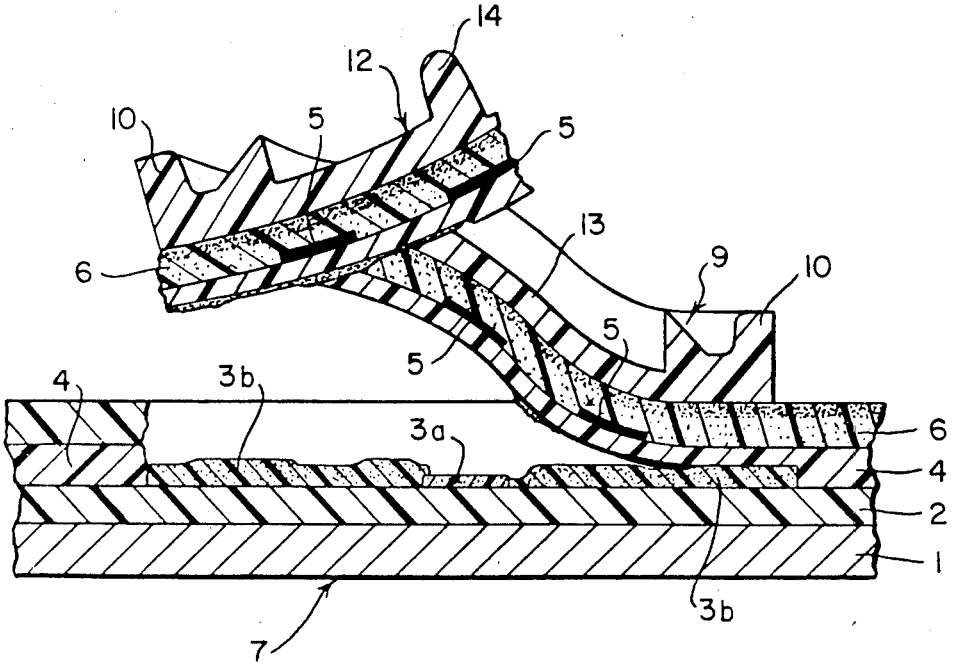

FIG. 9 illustrates the manner in which the liner of the cap of FIG. 7 is peeled from the cap as shown. The starting point for peeling the liner 9 occurs at the tip of the knob 14 over the section 3*a* where there is none or little adhesion between the layer 4 and 3*a*. Peeling is accomplished in the same manner as with the cap illustrated in FIG. 5.

Figure 8:
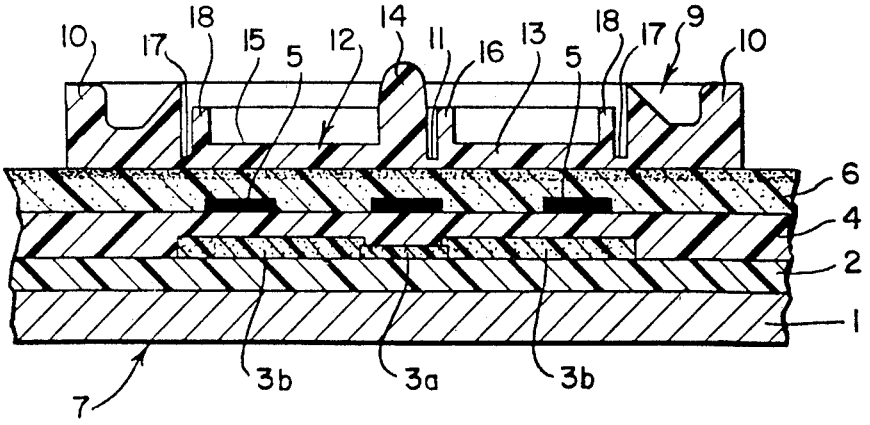
FIG. 8 is a sectional view of a still further embodiment of a closure cap constructed according to the invention; and, FIG. 9 illustrates peeling of the liner of the closing cap of FIG. 7.

A further embodiment of a reusable closure cap is shown in FIG. 8. There a liner 9 comprises a thick-wall seal member 10 and a thin-wall central section 13 having completely cut or breakable weakened lines 17 provided at the boundary thus making it possible to peel off the central section 13 thereby permitting the cap to hold its resealability after the liner is peeled off. A reinforcing rib 18 may be added at the inside part of the weakened line 17 in order that the center section 13 of the liner is peeled off in the disc shape.

To form the non-adhesive or weakly adhesive sections 3*a* and 3*b*, a resin having little or weak adhesiveness to the coating 4 is selected to form a partial coating 3*a*, and a resin having peelable strong adhesiveness to the coating 4 is selected to form a partial coating 3*b*.

The peelable strong adhesion as used herein means the adhesion of such a degree that two coatings may not be peeled off in the normal handling, but when a fracture for initiating peeling in the interface between the coatings is formed, the peeling may proceed readily without the use of a special tool. Generally, the degree of such adhesion is expressed in peeling resistance, and ranges from 50 to 2000 g/cm. Application of the partial coatings 3*a* and 3*b* is made easily by the flat-bed, relief, intaglia, screen or roller printing.

The control of the peeling property between coating layers can be easily achieved by using a combination of hydrocarbon resins and epoxy resins.

Therein making up sections 3*a* preferably comprises a hydrocarbon resin or a natural resin having a softening point (the ring-sphere motion) (c)below 180° C., because of the reasons described heretofore and because of the standpoint of workability for printing. Especially, a petroleum resin, a cumaron indene resin, a terpene resin, a rosin, a rosin ester and a rosin denatured resin are preferred.

The petroleum resin may be obtained through polymerization with heat addition from unsaturated petroleum hydrocarbons, such as a cyclopentadiene and high-class olefinic hydrocarbons (generally from $C_5$ to $C_{11}$), as the main feedstock are known, anyone of which may be used as a most preferred resin for the sections 3*a*. For the cumarone indene resin, those with relatively low polymerization degrees, produced from tar fraction (generally 160°-180° C.) mainly consisting of cumarone and indene through catalytic polymerization or with heat addition are known, and may be used as well. For the terpene resins, synthetic and natural polymers of a terpene hydrocarbon, especially a resin obtained through polymerization of a terpene oil or nopinene fraction in the presence of a catalyst are used. Besides the so-called raw rosin like gum rosin and wood rosin, rosin esters produced by esterification of abietic acid contained in rosin, e.g. glycerine ester of rosin (ester gum), abietic acid diethylene glycol 2-hydro abieate, monoethylene glycol ester of rosin, and pentaerythritol ester of rosin may be used. These rosins may be denatured with a known thermo-setting resin prior to the use.

For section 3*b* forming the strongly adhesive area, an acid denatured hydrocarbon resin or an acid denatured hydrocarbon resin composition having an acid value from 0.1 to 20, preferably from 1.0 to 10, is used. The preferred acid-denatured hydrocarbon resin includes an acid-denatured hydrocarbon resin obtained from the reaction between the hydrocarbon resin and an unsaturated carboxylic acid or its anhydride, and a partially ester-denatured hydrocarbon resin obtained from the partial reaction between an acid-denatured hydrocarbon resin and an alcohol.

For the ethylene unsaturated carboxylic acid or its anuhydride to react with these hydrocarbon resins, an acid monomer of an acrylic acid, methacrylic acid, maleic acid, monomethyl maleate ester, fumaric acid, monoethyl fumarate ester, crotonic acid, itaconic acid, citraconic acid or 5-norbornane-2, 3-dicarboxylic acid, and an acid anhydride monomer of a maleic anhydride, citraconic anhydride, itaconic anhydride, 5-norbornane-2, 3-dicarboxylic anhydride or tetrahydro phthalic anhydride may be used alone or in combination with two or more kinds.

For the acid monomer, an unsaturated fatty acid, such as an oleic acid, linolic acid and linoleic acid, and a fatty acid obtained from a drying oil of a cottonseed oil, linseed oil, safflower oil, soybean oil, dehydrated castor oil or tolu oil may be used. These acids or acid anhydride monomers may be used in combination with another monomer, such as ethyl acrylate, methyl methacrylate, 2-ethylhexyl acrylate, mono or diethyl maleate, vinyl acetate, vinyl propionate, acrylic amide, acrylic amide, methacrylic amide, maleic amide, acrolein, methacrolein, vinyl methyl ketone, vinyl butyl ketone, acrylonitrile, methacrylonitrile, propyl $\gamma$-hydroxymethacrylate, ethyl $\beta$-hydroxyacrylate, vinyl methyl ether, vinyl ethyl ether, allyl ethyl ether, glycidyl acrylate, glycidyl methacrylate and glycidyl vinyl ether.

The amount of acid or acid anydride monomer used is such that the hydrocarbon resin may have a final acid value in the range mentioned above.

These monomer and hydrocarbon resin may be reacted in a molten system, solution system, solid-gas or solid-liquid heterogeneous system. Addition or graft reaction between them may be started by heat; for the reaction in a molten system, the reaction may proceed sufficiently without any catalyst. Naturally, a radical starting agent or other radical starting means may be used. For the starting agent, the known catalytic amount of an organic peroxide, such as a dicumyl baroxyde, t-butylhydro baroxyde, dibenzoyl baroxyde and dilauroyl baroxyde, or azonitriles such as an azobisisobutylonitrile and azobisisopropionitrile. The radical starting means includes an ionizing radiation, such as X-rays, $\gamma$-rays and electron beam, ultraviolet rays or a combination thereof with a sensitizer, and a mechanical radical starting means such as kneading and ultrasonic radiation.

For example, in a homogeneous solution system, a petroleum resin, a monomer and a starting agent are dissolved in an aromatic solvent, such as toluene, xylene and tetralin, for grafting to form a precipitate of denatured hydrocarbon resin. For the reaction in a heterogeneous system, a powder of hydrocarbon resin and a monomer or a solution of monomer are brought into contact under radiation of ionizing rays for grafting. In a homogeneous molten system, a hydrocarbon resin and a monomer, and, if necessary, a starting agent are melted and kneaded in a stirring container, extruder or kneader to form a denatured hydrocarbon resin. In any case, the denatured hydrocarbon resin formed may be washed or extruded to remove unpolymerized monomer, homopolymer or a residual starting agent.

The acid-denatured hydrocarbon resin thus obtained is partially reacted with alcohols to form a partially ester-denatured hydrocarbon having an acid value in the above range for use in the invention. The usable alcohols include a monohydric alcohol, such as a methanol, ethanol and propanol, and a polyhydric alcohol, such as ethylene glycohol, propylene glycohol and glycerine. Esterification may be made by any of the known means.

Another example of acid-denatured hydrocarbon resin is that obtained by oxidation of a hydrocarbon resin with oxygen or oxygen containing gas such as air. The oxidation of a hydrocarbon resin can be easily made by blowing said gas over or into solution of the resin.

As far as the acid value of the final blend falls within the range defined in this invention, the acid-denatured or partially denatured hydrocarbon resin hereto described may be blended with an undenatured hydrocarbon resin, if necessary, for the section 3b.

Alternatively, an acid-denatured olefin resin is blended into an undenatured hydrocarbon resin or a natural resin so that the acid value of the final blend falls within the above range for use in forming the first coating.

The acid-denatured olefin resin includes a resin denatured by adding or grafting the above acid or acid anhydride monomer to an olefin resin such as a high-density polyethylene or an isotactic polypropylene. The preferred olefin resin feed includes the above, but if necessary a medium or low-density polyethylene or a crystalline ethylene-propylene copolymer may be used. The adding or grafting conditions are the same as those of the denatured hydrocarbon resin, and not described here. Instead of the olefin resin denatured with an acid or acid anhydride a polyethylene oxide, or an oxygen-containing polyethylene obtained by oxidizing a polyethylene in the molten or liquid state with molecular oxygen or the like may be used.

Preferably, these acid-denatured olefin resin and polyethylene oxide (B) may be blended with a hydrocarbon resin (A) in the following weight ratio:

A:B=99.5:0.5 to 40:60,
particularly 98:2 to 50:50

In the invention, the denatured hydrocarbon resin or denatured hydrocarbon resin composition could be used alone to form section 3b, but if necessary, it may be used in combination with less than 20% by weight of a known coating-film-forming base resin, such as a phenol resin, amino resin, epoxy resin, alkyde resin, rosins, oleorange, polyamide resin, polyester resin and vinyl resin, to form section 3b.

For section 3a, an acid-denatured hydrocarbon resin denatured to a lesser degree than the acid-denatured hydrocarbon resin forming section 3b, or a resin composition with a lower content of acid-denatured olefin resin or polyethylene oxide than the acid-denatured hydrocarbon resin composition forming section 3b may also be used. With this combination, the improved wetting characteristics between section 3a and section 3b is advantageous. Of course, a hydrocarbon resin with an undenatured olefin resin, such as waxy polyethylene, polypropylene and ethylene-propylene copolymer, may be used for the essentially undenatured hydrocarbon resin composition.

Preferably, the second coating 4 covers the entire surface of the metal sheet 1 using a paint having excellent workability, corrosion resistance and dust-free property. The preferred second coating is made of epoxy resin-containing paint which not only gives controlled peelability between the first paint layer 3a and 3b, but also has excellent processability, corrosion resistance and dust resistance properties.

The usable epoxy resin forming the coating 4 includes a high-molecular weight compound containing at least two epoxy groups in molecule, its initial reaction product or their mixture with a low- or high-molecular weight compound (hardening ingredient) reactive to the epoxy group.

Generally, it is preferred to use an epoxy resin obtained from condensation between an epichlorohydrin and a polyhydric phenol. Such an epoxy resin has the following molecular structure:

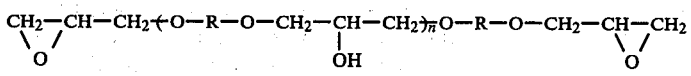

(1)

where n is zero or a positive integral number, especially no more than 12, and R is the hydrocarbon residue of the polyvalent phenol.

The preferred divalent phenol (HO—R—OH) includes a polycyclic phenol such as 2,2-bis(4-hydroxyphenyl)propane(bisphenol A), 2,2-bis(4-hydroxyphenyl)butane(bisphenol B), 1,1'-bis(4-hydroxyphenyl)ethane and bis(4-hydroxyphenyl)methane(bisphenol F). The bisphenol A is specially preferred, but the initial condensate between a phenol and a formaldehyde may be used for a polyvalent phenol. The preferred epoxy resin used as a resin ingredient has an epoxy equivalent from 140 to 4000, and particularly from 200 to 2500.

The hardener used with these epoxy resin ingredients includes a polyfunctional compound active to the epoxy group, such as a polybasic acid, acidic anhydride, polyamine and polyamide. Suitable examples are ethylenediamine, diethylenetriamine, triethylenetetramine, methaphenylenediamine, 4,4'-diaminodiphenyl methane, 4,4'-diaminodiphenylsulfone, 4,4'-diaminodiphenyl ether, polyamide dimerate, hydrazide adipate, oxalic acid, phthalic anhydride, maleic anhydride, hexahydrophthalic anhydride, pyromellitic dianhydride, cyclopentadienemethyl maleic adduct, dodecylsuccinic anhydride, dichloromaleic anhydride and chlorendic anhydride.

The preferred amount of hardener used for 100 parts by weight of the epoxy resin ingredient ranges from 2 to 150 parts by weight (hereinafter, percent and part are measured in weights unless otherwise specified), and particularly from 20 to 60 parts.

Preferably, the above epoxy resin ingredient is mixed with at least one kind of thermosetting resins including a resol-type phenol-formaldehyde resin, urea-formaldehyde resin and melamine formaldehyde resin to form the second coating 4. The ratio between them ranges generally from 5:95 to 95:5, and preferably from 40:60 to 90:10 by weight. The epoxy resin ingredient and the thermosetting resin may be used in the state of either a mixture or a preliminary condensation to form the coating 4.

The protective coating 2 is made preferably of vinyl resin, especially a copolymer between (a) a vinyl chloride and (b) at least one of ethylene unsaturated monomers such as vinyl acetate, vinyl alcohol, vinyl acetal, acrylic acid, methacrylic acid, maleic acid, fumaric acid, itaconic acid, alkyl acrylate ester, alkyl methacrylate ester and vinylidene chloride. The above compositions result in coatings having corrosion-resistance and processing characteristics. The preferred mole ratio of the vinyl chloride (a) to the other ethylene unsaturated monomer (b) ranges generally from 95/5 to 60/40, especially from 90/10 to 70/30. The molecular weight of the vinyl resin is such that a film may be formed.

Suitable examples of the vinyl resin are a vinyl chloride/vinyl acetate copolymer, partially saponified vinyl chloride/vinyl acetate copolymer, partially saponified and partially acetalized vinyl chloride/vinyl acetate copolymer, vinyl chloride/vinyl acetate/maleic anhydride copolymer and vinyl chloride/vinylidene chloride/acrylic acid copolymer.

In addition, an epoxy resin, amino resin, phenol resin, acrylic resin and vinylbutylal resin may be used alone or together, or in combination of the aforementioned vinyl resin. The strongly adhesive section 6b on the adhesive coating 6 of the cap of FIG. 3 as well as the coatings 6 of FIGS. 6, 7 and 8 are formed from a paint containing an acid-denatured olefin resin or polyethylene oxide is used for the olefin resin liner, and the aforementioned vinyl resin paint or acrylic resin paint is used for the vinyl chloride resin liner.

A coating having no or weak adhesiveness to the liner 9 is applied to the portion of the liner where a peel is initiated to form the non-adhesive or weak adhesive section 6a. The coatings 6a and 6b may be formed into a partial coating, or the coating 6a may be formed over the strong adhesive coating in the form of a masking layer.

When the strongly adhesive coating 6 is formed from a paint containing an acid-denatured olefin resin or polyethylene oxide, the strongly adhesive section 6b and the non-adhesive or weakly adhesive section 6a may be formed by controlling the distribution of an acid-denatured olefin resin or polyethylene oxide in the coating surface. Examples of such a distribution controlling agent are a petroleum resin and petroleum denatured resin. For example, as shown in FIG. 3, a distribution controlling coating 18 is formed under the adhesive coating 6 corresponding to the initial peel portion of the liner 9 to control the distribution of an acid-denatured olefin resin or polyethylene oxide toward the coating surface so as to form the non-adhesive or weakly adhesive section 6a.

The method of forming the liner 9 chosen from the standpoint of operability includes a method of extruding a thermoplastic resin into a cap shell and pressing the resin to simultaneously form it into a liner shape and to achieve thermal bonding. The method includes supplying a fluid composition such as a plastisol inside a cap shell and applying a centrifugal force to extend the fluid composition in the shell. Alternatively, a disk liner is formed with a thermoplastic resin outside a cap shell and then bonded to the top sheet of the shell.

As shown in the drawings, the liner 9 has a peeling starting portion provided at the front end of a peeling tab, preferably underneath the peeling knob. Where the liner does not have such a tab, the peeling starting portion may be provided on the peripheral portion of the liner.

The non-adhesive or weakly adhesive section 3a of the coating 3 is provided along the direction of peeling of the tab 12. In the embodiment shown in FIG. 3, the non-adhesive or weakly adhesive section 3a is formed between the coatings in a circular or ring form having a larger outer diameter than that of the non-adhesive or weakly adhesive section 6a of the liner 9.

Where peeling of the liner 9 is made from the liner periphery, the non-adhesive or weakly adhesive section 3a is formed between the coating so as to have a smaller inner diameter than that of the non-adhesive or weakly adhesive section of the liner 9.

EXAMPLE 1

A base coating (epoxy-amino paint), a print and a overcoating (epoxy ester paint) were formed on one of the surfaces (the outer surface of a crown cap) of a 0.25-mm, surface-treated steel sheet. A rust resistant undercoating lacquer, vinyl paint (a solution of 25% of a vinyl chloride/vinyl acetate copolymer VYHH UCC dissolved in an methylethyl ketone), was then roll coated over the other surface (the inner surface of a crown cap) in such a manner that the thickness of the dry coating was 3 microns. This coating was then heated at 180° C. for 10 minutes to form a coated sheet. A kerosene solution (50%) of a hydrocarbon resin (TAKKIROL 1000 made by SUMITOMO CHEMICAL INDUSTRY) was applied on the rust resistant undercoating in the form of a concentric circle having a 4 mm inner diameter and a 8 mm outer diameter and a thickness of 2 microns. A kerosene solution (50%) of the acid-denatured hydrocarbon resin (the softening point 105° C.; the acid value 4.6) obtained from the reaction with a maleic anhydride added under heat was applied outside the concentric circle in the form of another concentric circle having a 8 mm inner diameter and a 25 mm outer diameter and a thickness of 2 microns. This coating was then heated at 180° C. for 10 minutes to form the first coating. An epoxy ink (a 30% solution of EPICOAT 1004/EPOMATE B001/carbon black (80/20/5) in a solvent of equivalent amounts of xylene and methyl ethyl ketone) was then screen printed as a prize mark over the entire surface of the first coating, and heated at 190° C. for 10 minutes.

A masking composition consisting of 80 parts of a linseed oil-denatured alkyde resin, 2 parts of a manganese naphthenate, 10 parts of a precipitable calcium carbonate and 10 parts of a kerosene was applied to a 2.5-mm circle concentric with the first coating on the rust resistant undercoat at a thickness of 2 microns to form a masking coating.

Immediately thereafter the second coating was applied where the coating comprised a paint composition (the total solid component 30%) consisting of 70 parts of an epoxy resin (EPICOAT 1007), 20 parts of a phenol resin (HITANOL #2080), 10 parts of a polyethylene oxide (the density 1.0; the softening point 135° C.; and the total oxygen concentration 4.3%) and an organic solvent (a mixture of equivalent amounts of xylene and butyl cellosolve. This composition was roll coated in such a manner that the thickness of a dry coating was 2 microns. The coating was then heated at 190° C. for 10 minutes to form a printed and coated sheet.

This coated sheet was then pressed to form a crown shell such that the prize mark-printing surface would be on the inside of a crown cap and so that the center of the concentric first and masking coatings would be at the center of a crown cap made from the crown shell having an inner diameter 26 mm. About 250 mg of a molten low-density polyethylene (the melt index 7 and the density 0.92) was forced out of a 5-mm nozzle of a 40-mm extruder and cut by a cutting blade so as to fall into the inside of the crown shell which was preheated. Immediately thereafter the polyethylene was punched by a cooled punch to form a crown cap having a liner. The liner comprised a circular projection having an inner diameter of 19 mm and an outer diameter of 24 mm, two circular mounds having a height of 1.5 mm with a valley between the two mounds having a thickness of 0.3 mm. A thin portion having a diameter of 19 mm and a thickness of 0.2 mm was provided inside the circular projection. A tab was defined by a weakened line having a width of 0.5 mm and a thickness of 0.01 mm so as to extend from the central portion of the thin section to the inside circular projection. A pair of reinforcing ribs was provided on both sides of the weakened line having a width of 0.5 mm and a height of 1 mm. The tab had a knob the lower surface of which was 3 mm across, a height of 4 mm and an upper surface 2 mm across concentric with the thin section. The shape of the tab was defined by two tangents drawn from the periphery of the lower surface of the knob to the opposite ends of an arc 6 mm in length on the inner periphery of the circular projection.

In addition, a crown cap was made for comparative purposes (Comparative Example 1) having the same coating structure as that of Example 1 except that the first coating was made by using only a kerosene solution of the aforementioned hydrocarbon resin and a crown cap (Comparative Example 2) having the first coating made of only kerosene solution of the aforementioned acid-denatured hydrocarbon resin were formed. The crown caps obtained were tested for linear adhesiveness (the detaching of a liner by hoppering after one month of standing at room temperature), liner peelability (the easiness of peeling a liner from the crown cap that has been corked to a glass bottle and opened) and the transferrability of a prize print to the liner (expressed in percents). The results are listed in Table 1.

TABLE 1

| | Liner adhesiveness | Liner peelability* | Transferability (%) |
|---|---|---|---|
| Example 1 | 0 | 0 | 100 |
| Com.Ex. 1 | x | 0 | 100 |
| Com.Ex. 2 | 0 | v | 32 |

*Evaluation of the peelability
0: Easily peelable with fingers.
v: Peelable with a tool.
x: Not peelable

EXAMPLE 2

500 g of a terpene resin (YS RESIN PX made by YASUHARA RESIN having a softening point of 100° C.; an acid value 0.01, 6 g of a maleic anhydride and 0.02 g of a di-t-butyl peroxide were mixed and heated at 200° C. while stirring. When an acid value of 4 was reached, the reaction was terminated and excess maleic acid was washed out to yield a denatured terpene resin (A). The obtained denatured terpene resin (A) and an undenatured terpene resin (B) were dissolved in mineral spirit, respectively, to prepare a solution having viscosity suitable for printing.

The vinyl undercoating paint used in Example 1 was roll coated over both surfaces of a 0.24 mm-thick tinplate sheet in such a manner that the thickness of a dry coating would be 3 microns. This paint was dried by heating at 180° C. for 15 minutes. The above denatured terpene resin solution (A) and the undenatured terpene resin solution (B) were applied thereto by a two-color off-set printer to print such a pattern as shown in Table 2-1, and heated at 180° C. for 10 minutes to form a coated sheet having a ring-shaped printing on its one side.

An epoxy-urea paint (a 25% solution of EPICOAT #1007/SUPERBEKAMINE P-138 (80/20) in a mixture of equivalent amounts of SOLVESSO 100 and butyl cellosolve) was roll coated over the entire printed surface of the coated sheet in such a manner to form a dry coating of 4 microns thickener. This coating was baked by heating at 190° for 10 minutes. An ordinary metal printing ink was applied to the above epoxy-urea resin coating to print a prize mark in such a manner that the printing portion was identical with the printed portion of the denatured terpene resin. The ink was dried by heating at 150° C. for 15 minutes. The vinyl resin paint used as an undercoating paint was applied to the entire prize mark surface in such a manner that the thickness of the dry coating formed was 5 microns. The paint was dried by heating at 190° C. for 10 minutes. An alkyde resin ink was applied to the above vinyl resin coating to print a ring having an inner diameter of 20 mm and an outer diameter of 24 mm which was concentric with the undenatured terpene resin printing portion. The ink was heated at 150° C. for 10 minutes to form a coated metal sheet having a multi-layer ink coating on one side.

The coated sheet was pressed by a crown-cap forming press in such a manner that the prize print-bearing surface was inside a crown cap and so that the center of the masking coating provided on the uppermost layer was at the center of a crown cap to form a cap shell (the inner diameter of which was 26 mm) having various types of terpene resin printing on the inside of the shell.

Approximately 250 mg of a molten soft vinyl chloride resin (containing 40% of a DOP plasticizer) was forced out of a 5-mm nozzle of a 40-mm extruder and was cut off by a cutting blade at the nozzle tip so as to fall into the inside of the crown shell which was preheated. Immediately thereafter the resin was punched by a cooled punch to form a crown cap having a soft vinyl chloride resin liner of 24 mm in outer diameter. The same test as that of Example 1 was repeated for the obtained crown cap. The results are listed in Table 2-2.

In addition, the printing appropriateness (peeling of the second coating upon offsetting) was assessed.

TABLE 2-1

| | Denatured resin | | Undenatured resin | | Remarks |
|---|---|---|---|---|---|
| 1 | In.dia.0; | Out.dia.22 | In.dia.0; | Out.dia.0 | Denatured resin alone |
| 2 | In.dia.19 | Out.dia.22 | In.dia.0 | Out.dia.19 | |
| 3 | In.dia.0 | Out.dia.19 | In.dia.19 | Out.dia.22 | |
| 4 | In.dia.0 | Out.dia.0 | In.dia.0 | Out.dia.22 | Undenatured resin alone |

TABLE 2-2

| Shape | Liner adhesiveness | Liner peelability | Transferability (%) | Printing appropriateness |
|---|---|---|---|---|
| 1 | 0 | v | 32 | 0 |
| 2 | 0 | v | 70 | x (peeled) |
| 3 | 0 | 0 | 100 | 0 |
| 4 | x | 0 | 100 | x (peeled) |

EXAMPLES 3 through 6

An aromatic hydrocarbon resin (PETROJIN #120 made by MITSUI PETROLEUM CHEMICAL INDUSTRY) having a softening point of 120° C.; an average molecular weight of 870; and an acid value 0.01 was dissolved in a solvent of SOLVESSO #100 to prepare a 50%-resin solution C. The following four solutions 1 through 4 were prepared as an additive:

(1) A polyethylene oxide having a density of 1.0, a softening point of 135° C. and a carbonyl content of 35 meq/100 g was dissolved in a hot xylene at 120° C. to prepare a 20% solution.

(2) A maleic anhydride-denatured polyolefin was dissolved in a hot xylene to prepare a 20% solution.

(3) 500 g of linseed oil was dehydrated and boiled for 7 hours by blowing air into the oil at 120° C. to make a linseed-type boiled oil having an acid value of 2.9.

(4) 100 g of a vinyl chloride-vinyl acetate copolymer (VYHH) was dissolved in 400 g of a mixed solvent of cyclohexanon/xylene (80/20).

Five parts of the solid component of each of the solutions 1 through 4 was added to the solution C and stirred well to form different resin-added hydrocarbon resin compositions.

To make an undercoat, a phenol-denatured alkyde (PHTHALKYDE X-414 made by HITACHI KASEI) was applied on a 0.23 mm-thick surface-treated steel sheet in the shape of a circle 25 mm across at a thickness of 2 microns, and then dried by heating at 180° C. for 10 minutes. To form the first coating over the undercoat, the above sample solution C was applied to the ring portion having an inner diameter of 4 mm and an outer diameter of 8 mm at a thickness of 2 microns. The above different resin-added hydrocarbon resin compositions were then applied to the ring portion having an inner diameter of 8 mm and an outer diameter of 25 mm at a thickness of 2 microns, and then dried by heating at 180° C. for 10 minutes.

To form the second coating, the epoxy urea paint used in Example 2 was roll coated over the undercoat and the first coating in such a manner that the thickness of the dry coating formed was 2 microns. This coating was baked by heating at 190° C. for 10 minutes. A conventional metal printing ink was applied to the portion corresponding to the first coating on the above epoxy urea paint film to print a prize mark. The ink was dried by heating at 150° C. for 10 minutes. To form a masking coating, the masking composition used in Example 1 was applied to the 2.5-mm circular portion concentric with the first coating on the undercoat at a thickness of 2 microns. Immediately thereafter the paint composition used in Example 2 for forming the second coating was roll coated in such a manner that the thickness of the dry coat formed was 2 microns. The coating was heated at 190° C. for 10 minutes to form a printed and coated sheet. The same process as that of Example 1 was repeated for this coated sheet to form crown caps having a prize print on the inside of the top sheet and a polyethylene liner with a knob.

For comparison, a crown cap having the same coating structure as that of this Example except that the first coating was made by using only the resin solution C (Comparative Example 3) and crown caps having the first coating made of each of the above different resin-added hydrocarbon resin compositions (Comparative Examples 4 through 7) were formed. The crown caps obtained were tested in the same manner as that of Example 1, giving the results as shown in Table 3.

With a crown cap of the invention, peeling the liner may be initiated easily with fingers from the peeling starting portion due to the fact that the polyethylene liner and the uppermost coating are non-adhesive or have little adhesive due to the masking layer. Successively, when the uppermost and the second coating are pulled up, the liner is lifted and broken off in such a manner that the prize print strongly adhering to the second coating may be transferred to the second coating in unbroken form.

TABLE 3

| | Resin added | Liner adhesive | Liner Peelab. | Transfer. (%) |
|---|---|---|---|---|
| Example 3 | (1) | 0 | 0 | 100 |
| Example 4 | (2) | 0 | 0 | 100 |
| Example 5 | (3) | 0 | 0 | 100 |
| Example 6 | (4) | 0 | 0 | 100 |
| Com.Ex. 3 | None | x | 0 | 100 |
| Com.Ex. 4 | (1) | 0 | v | 44 |
| Com.Ex. 5 | (2) | 0 | v | 53 |
| Com.Ex. 6 | (3) | 0 | v | 48 |
| Com.Ex. 7 | (4) | 0 | v | 65 |

By contrast, the crown caps of Comparative Examples 1 and 3 had a perfect transferability, but a poor necessary sealing function because of drop of the liner. The crown caps of Comparative Examples 2, 4, 5, 6 and 7 had the same easiness in initiating peeling as that of the embodiment of the invention. However they had a disadvantage in that the liner having a part of the prize print transferred was peeled off since the second coating and the first coating were adhered so strongly together that a break of the uppermost and the second coatings failed to occur in the vicinity of the peel start portion.

EXAMPLE 7

A crown cap was prepared in the same manner as in Example 1 except that the first coating applied over the rust resistant undercoating was in the form of a circle having a diameter of 6 mm and in that kerosene solution applied outside the first solution had an inner diameter of 6 mm and an outer diameter of 25 mm. In addition the knob of the tab was in the form of a truncated cone having a bottom diameter of 8 mm, a top diameter of 2 mm and a height of 4 mm.

Comparative example crown caps 1 and 2 were prepared under the comparative example crown caps 1 and 2 of Example 1 and the same comparative tests were made as the test described in connection with Table 1. These tests are shown in Table 4.

TABLE 4

| | adherent property of liner | peeling property of liner* | transfer property of liner (%) |
|---|---|---|---|
| Example 1 | O | O | 100 |
| Reference Example 1 | X | O | 100 |
| Reference Example 2 | O | X | |

*Evaluation of the easiness for peeling-off
O: easily peelable by the fingers
X: not peelable

EXAMPLE 8

Crown caps were prepared in the same manner as in Example 2 except that the dimensions of the printed portions of the denatured and undenatured resins were as shown in Table 5, in that the epoxy-urea-type paint was roll coated to give a thickness of 3 mm when dried and in that no alkyde resin ink was applied over the second vinyl coating.

TABLE 5

| shape | denatured resin | | | | undenatured resin | | | | comments |
|---|---|---|---|---|---|---|---|---|---|
| 1 | ID | O | OD | 24 | ID | O | O | O | denatured resin |

TABLE 5-continued

| shape | denatured resin | | | | undenatured resin | | | | comments |
|---|---|---|---|---|---|---|---|---|---|
| | | | | | | | | | alone |
| 2 | ID | 19 | OD | 24 | ID | O | OD | 19 | |
| 3 | ID | O | OD | 19 | ID | 19 | OD | 24 | |
| 4 | ID | O | OD | O | ID | O | OD | 24 | undenatured resin alone |

The crown caps prepared to the dimensions of Table 5 were evaluated in the same manner as those in Example 1 and the results are shown in Table 6.

TABLE 6

| shape | adherent property of liner | peeling property of liner | transfer property of liner (%) | suitability for printing |
|---|---|---|---|---|
| 1 | O | X | | O |
| 2 | O | X | | X (separation) |
| 3 | O | O | 100 | O |
| 4 | X | O | 100 | X (separation) |

EXAMPLES 9–12

Crown caps were prepared in the manner of Examples 3–6 except that trial solution C was painted in an area of 6 mm diameter and in that no masking coating was used.

Reference crown caps were prepared similar to those of Example 1 except that in reference Example 8 the first coating layer was made using resin solution C alone. Reference Examples 9–12 were the same material for the first coating layer used in the crown caps prepared in Example 1. The crown caps were evaluated in the same manner as in Example 1 with the results being shown in Table 7.

TABLE 7

| | resins added | adherent property of liner | peeling property of liner | transfer property of liner (%) |
|---|---|---|---|---|
| Example 3 | (1) | O | O | 100 |
| Example 4 | (2) | O | O | 100 |
| Example 5 | (3) | O | O | 100 |
| Example 6 | (4) | O | O | 100 |
| Reference Example 8 | NIL | X | O | 100 |
| Reference Example 9 | (1) | O | X | |
| Reference Example 10 | (2) | O | X | |
| Reference Example 11 | (3) | O | X | |
| Reference Example 12 | (4) | O | X | |

As shown in Table 7 since the crown caps of the present examples had strong adhesion at the starting part of the peeling between the polyethylene liner and the uppermost layer and since the second coating film layer was broken when the knob was pressed, the subsequent pulling-up of the knob made it possible to peel off the liner completely. In contrast to the above, reference examples 1 and 8 exhibited a shortcome of falling-down of the liners which was essential for the sealability of the crown, although the peeling property and the transfer property were good. Crowns of reference examples 2, 9, 10, 11 and 12 caused difficulties in the peeling property.

EXAMPLE 13

An aromatic hydrocarbon resin (trademark: PETROJIN #120 made by MITSUI PETROCHEMICAL INDUSTRY), having a softening point of 120° C., an average molecular weight of 870, an acid value of 0. was dissolved in n-paraffin (made by NISSEKI CHEMICAL Bp 235°–270° C.) to form a resin solution with a concentration of 50 wt%. Then hydrocarbon resin compositions were made by mixing various resin materials into the hydrocarbon resin solution as shown in Table 8.

TABLE 8

| | resin added | amount added (PHR) |
|---|---|---|
| NO. 1 | polyethylene wax* 1 | 10 |
| 2 | polyethylene wax* 2 | 10 |
| 3 | polypropylene wax* 3 | 10 |

* 1 SUNWAX 151P
* 2 SUNWAX 161P
* 3 BISCOL 550P

A base coating layer (epoxy-amino paint), printing, and an overcoating layer (epoxy-ester paint) were applied on one side (the side which formed the outer surface of the container cap) of a surface treated steel sheet 0.25 mm in thickness. Then an epoxy-phenol paint (EPICOAT #1007/ cresol/chloroform condensation product=75/25 dissolved into equal amounts of xylene and MIBK to form a solution of 30 wt%) was roll-coated as a rust-preventive undercoating lacquer on the other surface (the surface which became the inner surface of the container cap) so as to form a dry film of 8 in thickness, followed by drying by heating at 190° C. for 10 minutes. Then using a two-color off-set printing machine, a first coating layer was printed over the center-coating lacquer layer, the hydrocarbon resin composition being printed 2 in thickness and in an area of 6 mm diameter. A kerosene solution (50 wt %) of acid denatured hydrocarbon resin (softening point 105° C., acid value 4.6) obtained by reacting maleic anhydride under heat was then printed 2 in thickness in the form of a concentric ring having an inner diameter of 6 mm and an outer diameter of 25 mm. This was followed by heating at 180° C. for 10 minutes.

An epoxy-urea paint used for the second coating film layer of Example 2 was roll-coated as a second coating film layer over the first coating layer so as to form a dry film having a thickness of 4 mm. This was followed by baking at 190° C. for 10 minutes. A conventional ink for metal printing prize markings was then printed in an area of 25 mm diameter (circular area concentric to the first coating film layer) and over the epoxy-urea resin coating film. This layer was then dried by heating at 150° C. for 15 minutes. The paint composition used for the second coating film layer of Example 1 was then roll-coated over the entire surface of the sheet with the prize marking so as to form a dry film thickness of 2 mm, its coating layer being dried by heating at 190° C. for 10 minutes. A sheet painted and printed on both sides having prize markings on one side was thereby formed. Crowns with prize markings on the inner surface and a polyethylene liner with a knob as a lining were made from the painted sheet by repeating the same operations as those described for Example 7. The crowns thus obtained were evaluated in the same way as Example 1. The results are shown in Table 9.

TABLE 9

| | adherent property of liner | peeling property of liner | transfer property of liner (%) |
|---|---|---|---|
| No. 1 | O | O | 100 |
| No. 2 | O | O | 100 |
| No. 3 | O | O | 100 |

REFERENCE EXAMPLE 13

A sheet painted and printed on both sides was made following the same operations as those for Example 13 except that the area of 6 mm diameter was modified to an area of 4 mm inner diameter and 8 mm outer diameter for the area printed with the hydrocarbon resin composition. In addition the area of 6 mm inner diameter and 25 mm outer diameter was modified to an area of 8 mm inner diameter and 25 mm outer diameter for the area printed with the acid-denatured hydrocarbon resin. Then a masking composition comprising 80 weight parts of linseed oil denatured alkyde resin, 10 weight parts of calcium carbonate precipitate, 2 weight parts of manganese naphthenate and 10 weight parts of kerosene was printed on the uppermost layer of the side of the painted sheet with the prize markings and in a circular area of 5 mm diameter with the center located at the same position as that of the first coating film layer. This layer was then dried by heating at 150° C. for 10 minutes. A painted and printed sheet with a masking layer on the uppermost layer was thereby prepared.

EXAMPLE 14

The painted and printed sheet obtained in Example 13 and Reference Example 13 was pressed to form a screw cap shell having an inner diameter of 38 mm in such a way that the side with the prize markings was facing inside and the enter of the prize printing area was the same as the center of the cap. Screw caps with a polyethylene liner with a knob in a shape similar to that shown in FIG. 8 was made by cutting off about 1 g of molten polyethylene in the inner side of the cap shell by the same operations as those used in Example 7, immediately followed by punching by a cooled punch. The liner obtained had a knob at the center of the cap in a truncated cone shape with a bottom diameter of 3 mm, a top diameter of 2 mm and a height of 4 mm. Weakened lines dividing the part to be peeled were made from the center of the top of the cap to a circumference 12.5 mm in radius. A circular protrusion for sealing was formed in the area of 28 mm inner diameter and 38 mm outer diameter. Those screw caps with a polyethylene liner with a knob were put on a glass bottle to seal a carbonated drink and then opened. The caps opened were evaluated for resealability in addition to those properties evaluated in Example 7. The results are shown in Table 10.

TABLE 10

| | | adherent property of liner | peeling property of liner | transfer property (%) | Resealability |
|---|---|---|---|---|---|
| Example 13 | No. 1 | O | O | 100 | O |
| Example 13 | No. 2 | O | O | 100 | O |
| Example 13 | No. 3 | O | O | 100 | O |
| Reference Example 13 | | O | O | 96 | O |

The cap of the present example showed perfect transfer of the prize markings to the entire surface of the shell side of the liner, but the caps of the reference examples produced incomplete prize markings on the liner side as a portion of the prize markings printed in the central area remained on the shell side and was not transferred to the liner side. For resealability, no difference was found among the caps, but dust fragments were found for some caps of reference Example 8.

We claim:

1. A closure cap comprising a cap shell, a liner adhered to the inside surface of said shell through a plurality of adjacent coating layers having peelable interfaces therebetween and an ink layer containing printed matter on one of said coating layers and positioned between two adjacent coating layers; the improvement comprising in that said liner has a starting portion for initiating peeling of the liner from the cap shell, in that the coating layer adjacent said liner comprises a topmost layer, in that a coating layer adjacent said topmost layer comprises an intermediate layer having said ink layer thereon, in that the peel resistance between said topmost layer and said intermediate layer is less than the peel resistance between the topmost layer and said liner, in that the coating layer adjacent said intermediate layer on the opposite side thereof from the topmost layer comprises a bottommost layer, and in that the peel resistance between said adjacent coating layers adjacent said starting portion is less than the peel resistance between adjacent coating layers further away from said starting portion.

2. A closure cap according to claim 1 further characterized in that said peeling interface on the bottommost coating layer comprises a hydrocarbon resin, in that said intermediate coating layer contains an epoxy resin, in that said bottommost coating layer in the area adjacent to said starting portion is made of an essentially undenatured hydrocarbon resin, and in that the area further away from said starting portion is made of a denatured hydrocarbon resin or denatured hydrocarbon resin composition having an acid value from 0.1 to 20.

3. A closure cap according to claim 1 wherein said liner has a relatively thin-wall center section and thick-wall peripheral section with said starting portion located in the thin-wall center section.

4. A closure cap according to claim 1 wherein said liner has a peel tab sectioned in the liner by means of weakened lines defining the direction of the peel with the starting portion for peel of said liner being located at the leading edge of said tab.

5. A closure cap according to claim 1 wherein said liner is made of an olefin resin and the uppermost surface of the coating layer adjacent said liner contains polyethylene oxide.

6. A closure cap according to claim 1 wherein said liner is made of an olefin resin and the uppermost surface of the coating layer adjacent said liner contains an acid-denatured olefin resin.

7. A closure cap according to claim 1 where said liner is made of a vinyl chloride resin and the uppermost surface coating of the layer adjacent the liner is made of a vinyl resin paint.

8. A closure cap according to claim 1 wherein said liner is made of a vinyl chloride resin and the uppermost surface of the coating layer adjacent the liner is made of an acrylic resin type paint.

9. A closure cap according to claim 1 wherein the peel resistance between the topmost coating layer adjacent said liner in the area adjacent said starting portion and said liner is less than the peel resistance between said topmost coating layer and said liner in an area further away from said starting portion.

10. A closure cap according to claim 9 wherein said liner is made of an olefin resin, and in that the topmost coating layer comprises a paint containing a polyethylene oxide in the area further away from the starting portion and a paint free of polyethylene oxide in the area adjacent said starting portion.

11. A closure cap according to claim 9 wherein said liner is made of an olefin resin, and in that the topmost coating layer comprises a paint containing an acid-denatured olefin in the area further away from the starting portion and a paint free of an acid-denatured olefin resin in the area adjacent said starting portion.

12. A closure cap according to claim 9 wherein said topmost coating layer comprises a resin and said intermediate coating layer comprises an epoxy resin with the area of said topmost coating layer adjacent said starting portion comprising a hydrocarbon resin having substantially no carbonyl group therein and with the area of said topmost first coating layer further away from said starting portion comprising a hydrocarbon resin having an acid value between 0.1 and 20.

13. A closure cap according to claim 9 wherein one coating layer has a hydrocarbon portion and a polyethylene oxide portion, and an adjacent coating layer comprises an epoxy resin with the portion of the one layer containing the polyethylene oxide being predominantly distributed in said area further from said starting portion.

14. A closure cap according to claim 9 including two coating layers with one layer having a hydrocarbon portion and an acid-denatured olefin resin portion, and the other coating layer comprising an epoxy resin with the portion of the one layer containing the acid-denatured olefin resin being predominantly distributed in said area further from said starting portion.

* * * * *